US012435488B2

(12) United States Patent
Gentle et al.

(10) Patent No.: US 12,435,488 B2
(45) Date of Patent: Oct. 7, 2025

(54) CROSS SLOPE WITH GRADE COMPENSATION

(71) Applicant: Caterpillar Inc., Peoria, IL (US)

(72) Inventors: Michael C. Gentle, Maroa, IL (US); Ethan M. Tevis, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 268 days.

(21) Appl. No.: 18/342,946

(22) Filed: Jun. 28, 2023

(65) Prior Publication Data

US 2025/0003180 A1 Jan. 2, 2025

(51) Int. Cl.
*E02F 3/84* (2006.01)
*E02F 9/26* (2006.01)

(52) U.S. Cl.
CPC ..... *E02F 3/845* (2013.01); *E02F 9/264* (2013.01)

(58) Field of Classification Search
None
See application file for complete search history.

(56) References Cited

U.S. PATENT DOCUMENTS

| | | | | |
|---|---|---|---|---|
| 2,241,666 | A * | 5/1941 | Hueter, Jr. | E02F 3/7613 172/815 |
| 3,786,687 | A | 1/1974 | Gasner | |
| 3,786,871 | A | 1/1974 | Long et al. | |
| 3,791,452 | A | 2/1974 | Long et al. | |
| 5,107,932 | A | 4/1992 | Zachman et al. | |
| 6,112,145 | A | 8/2000 | Zachman | |
| 9,328,479 | B1 * | 5/2016 | Rausch | E02F 9/265 |
| 10,620,004 | B2 | 4/2020 | Gentle et al. | |
| 2014/0326471 | A1 | 11/2014 | Zhu et al. | |
| 2020/0102718 | A1 * | 4/2020 | Cline | E02F 3/765 |
| 2024/0287755 | A1 * | 8/2024 | Kassen | E02F 3/847 |

FOREIGN PATENT DOCUMENTS

| | | |
|---|---|---|
| CN | 110056026 B | 8/2021 |
| CN | 110258686 B | 11/2021 |

* cited by examiner

*Primary Examiner* — Hunter B Lonsberry
*Assistant Examiner* — Robert L Pinkerton

(57) ABSTRACT

A mobile construction equipment for operation on a surface having at least one longitudinal slope grade includes: a blade that is movable with respect to the mobile construction equipment, the blade having a first blade side and a second blade side opposite the first blade side, the blade imparting at least one cross slope grade on the surface; and a controller for receiving the at least one longitudinal slope grade, a first blade side position of the first blade side, and at least one target cross slope grade, and, based on the at least one longitudinal slope grade and the first blade side position, adjusting a second blade side position of the second blade side so as to impart the at least one target cross slope grade on the surface.

20 Claims, 9 Drawing Sheets

| LONGITUDINAL SLOPE GRADE | TARGET CROSS SLOPE GRADE |
|---|---|
| 0% | 4.50% |
| 1% | 4.25% |
| 2% | 4.00% |
| 3% | 3.75% |
| 5% | 3.50% |

CROSS SLOPE WITH GRADE COMPENSATION

FIELD

The present disclosure generally relates to mobile construction equipment, such as a motor grader, and more particularly to using the mobile construction equipment to establish proper cross slope of a surface, such as a road, despite changes in a longitudinal slope of the road.

BACKGROUND

Construction equipment, such as a motor grader, can be used for road work, ditch work, site preparation, and other surface contouring and finishing tasks. Using a work implement, such as a blade assembly, the motor grader can impart a cross slope section and/or a longitudinal slope section on the road on which it is operating. Cross slope grade is the transverse slope of the road surface, extending laterally and measured relative to the horizon. Cross slope grade measures the crown of a road, which generally includes a high point at the center and downwardly-sloping sides when viewed as a lateral cross section. Proper cross slope grade provides a gradient for water runoff into a drainage system such as a street gutter or ditch. Maintaining the proper cross slope grade of a road is important for water drainage and safe operation of vehicles on the road, particularly in mining and construction environments. Longitudinal slope grade, by comparison, is the slope of the road with respect to the direction of travel relative to the horizon. Longitudinal slope grade measures the grade of the road over a distance traveled, which affects the load on work machines carrying heavy cargo. While a motor grader can impart a longitudinal slope section on a road, the road may instead already have an existing longitudinal slope section prior to the motor grader working the surface of the road.

FIG. 1 shows an exemplary cross-sectional view of a road 100. Cross section 102 shows crown 104, which includes high point 106 and cross slope sections 108, which are the downwardly-sloping sides extending from high point 106. Adjacent to cross slope sections 108, cross section 102 includes fore slope sections 110 and back slope sections 112, which together form ditch 114, which helps facilitate drainage of road 100. In the illustration shown, cross slope sections 108 each have a cross slope grade $G_{CS}$ of approximately three percent with respect to horizon H, where $G_{CS}$ is calculated as 100×(rise/run).

FIG. 2 shows an exemplary side view of a conventional motor grader 10 on a road 100 having a longitudinal slope section 116. Longitudinal slope section 116 could be pre-existing or created by motor grader 10. In the illustration shown, longitudinal slope section 116 has a longitudinal slope grade $G_{LS}$ of approximately five percent with respect to horizon H, where Gus is calculated as 100×(rise/run). Although longitudinal slope grade $G_{LS}$ shown in FIG. 2 is a positive value (i.e., five percent), which indicates that rise increases as run increases, longitudinal slope grade $G_{LS}$ could also be a negative value, which would indicate that rise decreases as run increases, or zero. The present application is equally applicable to both positive, zero, and negative longitudinal slope grades Gus for longitudinal slope section 116.

FIGS. 3-4 are schematic views of a conventional motor grader 10, which can be used to impart slope sections on a road 100 (i.e., by grading road 100), including cross slope section 108, fore slope section 110, back slope section 112, and/or longitudinal slope section 116, among others. As shown, motor grader 10 includes a front frame 12, rear frame 14, and a work implement 16. e.g., a blade assembly 18. Rear frame 14 includes a power source, contained within a rear compartment 20, that is operatively coupled through a transmission to rear traction devices or wheels 22 for primary machine propulsion.

Rear wheels 22 are operatively supported on tandem axles 24, which are pivotally connected to motor grader 10 between rear wheels 22 on each side of motor grader 10. The power source may be, for example, a diesel engine, a gasoline engine, a natural gas engine, or any other engine. The power source may also be an electric motor linked to a fuel cell, capacitive storage device, battery, or another source of power. The transmission may be a mechanical transmission, hydraulic transmission, or any other transmission type. The transmission may be operable to produce multiple output speed ratios (or a continuously variable speed ratio) between the power source and driven traction devices. Motor grader 10 also includes an articulation joint 62 that pivotally connects front frame 12 and rear frame 14, such that front frame 12 can pivot relative to rear frame 14 about an articulation axis B to help facilitate steering of motor grader 10.

Front frame 12 typically supports an operator station 26 that contains operator controls, along with one or more user interfaces 27 for conveying information to the operator for operation of motor grader 10 or inputting information. For example, motor grader 10 may include a machine speed sensor 90, which could be any sensor configured to monitor machine speed V, including sensors associated with any of the front wheels 58, 60, rear wheels 22, axle shafts, motors, or other components of the drivetrain of motor grader 10. Machine speed V could be displayed on user interface 27 within operator station 26.

Motor grader 10 may also work in conjunction with a global navigation satellite system, or GNSS. A GNSS is a satellite navigation system with global coverage that can be used to provide autonomous geo-positioning of objects associated with the GNSS, such as an autonomously operated motor grader. One example of a GNSS is a global positioning system, or GPS. The GNSS may include a satellite positioning unit 88 disposed on motor grader 10. Satellite positioning unit 88 generates signals indicative of location L of motor grader 10 (e.g., on road 100). Satellite positioning unit 88 may determine and generate signals corresponding to the latitude and/or longitude of motor grader 10. Satellite positioning unit 88 may be disposed on a top portion of motor grader 10 (e.g., on operator station 26, as shown in FIG. 3), to communicate with a number of satellites of the GNSS and to receive signals indicative of location L of motor grader 10, although satellite positioning unit 88 may be disposed elsewhere on motor grader 10.

Front frame 12 may also include a beam 28 that supports blade assembly 18 and is employed to move blade 30 to a wide range of positions relative to motor grader 10 (e.g., to impart on road 100 cross slope section 108, fore slope section 110, back slope section 112, and/or longitudinal slope section 116 at one more grades G). As shown in FIG. 4, blade 30 has a first blade side 31A and a second blade side 31B opposite first blade side 31A. Blade assembly 18 includes a drawbar 32 pivotally mounted to a first end 34 of beam 28 via a ball joint or the like. The position of drawbar 32 is typically controlled by hydraulic cylinders: a right lift cylinder 36 and left lift cylinder 38 that control vertical movement, and a center shift cylinder 40, as shown in FIG. 3, that controls horizontal movement. Right and left lift cylinders 36, 38 are connected to a coupling 70 that includes lift arms 72 pivotally connected to beam 28 for rotation about axis C. A bottom portion of coupling 70 may have an adjustable length horizontal member 74 that is connected to center shift cylinder 40.

Drawbar 32 may include a large, flat plate, commonly referred to as a yoke plate 42. Beneath yoke plate 42 is a circular gear arrangement and mount, commonly referred to as a circle 44. Circle 44 is rotated by, for example, a hydraulic motor referred to as a circle drive 46. Rotation of circle 44 by circle drive 46 rotates blade 30 about an axis A perpendicular to a plane of drawbar yoke plate 42. The blade cutting angle is defined as the angle of work implement 16 relative to a longitudinal axis 48 of front frame 12. For example, at a zero degree blade cutting angle, blade 30 is aligned at a right angle to longitudinal axis 48 of front frame 12 and beam 28, as shown in FIG. 4.

Blade 30 is also mounted to circle 44 via a pivot assembly 50 that allows for tilting of blade 30 relative to circle 44. A blade tip cylinder 52 is used to tilt blade 30 forward or rearward. In other words, blade tip cylinder 52 is used to tip or tilt a top edge 54 of blade 30 relative to a bottom cutting edge 56 of blade 30, which is commonly referred to as a blade tip. Blade 30 is also mounted to a sliding joint associated with circle 44 that allows blade 30 to slide or shift from side-to-side relative to circle 44. The side-to-side shift is commonly referred to as blade side shift. A side shift cylinder or the like is used to control the blade side shift.

The foregoing components together allow for movement of blade 30 in a number of different manners, all of which can be used to impart, for example, one or more cross slope grades $G_{CS}$ on cross slope sections 108.

To impart cross slope grade $G_{CS}$, motor grader 10 typically includes an automatic cross slope control system where the operator manually controls one side of blade 30 (e.g., first blade side 31A), while the other side of blade 30 (e.g., second blade side 31B) is automatically controlled, all resulting in blade 30 being positioned in a desired overall blade position $P_{30}$ leading to a desired cross slope grade $G_{CS}$.

Such automatic control of cross slope grade $G_{CS}$ is accomplished in part by determining overall blade position $P_{30}$ using one or more sensors. For example, as shown in FIG. 5, motor grader 10 includes mainfall sensor 80, rotation sensor 82, and blade slope sensor 84. These sensors may be used to measure the mainfall or pitch of motor grader 10, the blade slope of blade 30, and the circle rotation angle of circle 44, respectively. If overall blade position $P_{30}$ is known (i.e., based on the output of the sensors), the positions of various parts of blade 30 (e.g., a first blade side position $P_{31A}$ of the first blade side 31A, a second blade side position $P_{31B}$ of the second blade side 31B, etc.) can also be determined since the dimensions of blade 30 are fixed.

Mainfall sensor 80 may be a single multi-axis inertial measurement unit configured to produce a signal indicative of the longitudinal pitch of motor grader 10 and a signal indicative of the lateral roll of motor grader 10. The longitudinal pitch of motor grader 10 may be equivalent to longitudinal slope grade $G_{LS}$ of longitudinal slope section 116 of road 100 on which motor grader 10 is situated. Inertial measurement units are self-contained sensor systems capable of generating signals indicative of linear and angular motion. A multi-axis inertial measurement unit includes two or more gyroscopes and accelerometers for measuring linear and angular motion in at least two dimensions (e.g., along two axes). The axes of the multi-axis inertial measurement unit are typically aligned with the longitudinal axis of motor grader 10 (e.g., longitudinal axis 48 of front frame 12) and the lateral axis of motor grader 10 to generate signals indicative of the longitudinal pitch and lateral roll of motor grader 10, respectively.

Rotation sensor 82 may be configured to produce a signal indicative of the angle of blade 30 relative to front frame 12 and the lateral axis of motor grader 10. Rotation sensor 82 produces a signal indicative of the direction of blade 30 relative to the direction of travel of motor grader 10 (e.g., along road 100).

Blade slope sensor 84 may be configured to produce a signal indicative lateral slope of blade 30. The axis of mainfall sensor 80 is aligned with the longitudinal axis of motor grader 10 (e.g., longitudinal axis 48 of front frame 12) to generate signals indicative of the longitudinal pitch of motor grader 10, while blade slope sensor 84 generates signals indicative of the lateral roll of motor grader 10 when blade 30 is aligned with a lateral axis of motor grader 10. The lateral slope of motor grader 10 may be equivalent to a target cross slope grade $T_{GCS}$ of blade 30 of motor grader 10, as discuss in more detail below.

Rotation sensor 82 can be used in conjunction with blade slope sensor 84 to determine the lateral roll of motor grader 10 when blade 30 is aligned with the lateral axis of motor grader 10, ensuring the signals from blade slope sensor 84 are measuring the slope of a surface that is perpendicular to the direction of travel of motor grader 10.

During maintenance of road 100, an operator of motor grader 10 may need to adjust cross slope grade $G_{CS}$ of cross slope section 108 while a longitudinal slope grade $G_{LS}$ of longitudinal slope section 116 is changing. For example, if longitudinal slope grade $G_{LS}$ is increasing, cross slope grade $G_{CS}$ may need to be decreased. Conversely, if longitudinal slope grade $G_{LS}$ is decreasing, cross slope grade $G_{CS}$ may need to be increased. However, implementing such control is complex, as it requires an operator to simultaneously steer motor grader 10, estimate longitudinal slope grade $G_{LS}$, manually control one side of blade 30 (e.g., first blade side 31A), and manually change a target cross slope grade $T_{GCS}$ of blade 30 to implement a proper cross slope grade $G_{CS}$. The complexity of this operation typically results in inconsistent cross slope grade $G_{CS}$, incorrect cross slope grade $G_{CS}$, and variation in carrying out the operation across different operators of motor grader 10.

SUMMARY

One aspect of the present disclosure is directed to a mobile construction equipment for operation on a surface having at least one longitudinal slope grade, the mobile construction equipment comprising: a blade that is movable with respect to the mobile construction equipment, the blade having a first blade side and a second blade side opposite the first blade side, the blade being configured to impart at least one cross slope grade on the surface; and a controller configured to receive the at least one longitudinal slope grade, a first blade side position of the first blade side, and at least one target cross slope grade, and, based on the at least one longitudinal slope grade and the first blade side position, adjust a second blade side position of the second blade side so as to impart the at least one target cross slope grade on the surface.

Another aspect of the present disclosure is directed to a method for imparting at least one cross slope grade on a surface using a mobile construction equipment having a blade with a first blade side and a second blade side opposite the first blade side, the surface having at least one longitudinal slope grade, the method comprising: receiving the at least one longitudinal slope grade, a first blade side position of the first blade side, and at least one target cross slope grade; and based on the at least one longitudinal slope grade and the first blade side position, adjusting a second blade side position of the second blade side so as to impart the at least one target cross slope grade on the surface.

A further aspect of the present disclosure is directed to a controller for a mobile construction equipment having a blade that is movable with respect to the mobile construction equipment to impart at least one cross slope grade on a surface on which the mobile construction equipment is operating, the blade having a first blade side and a second blade side opposite the first blade side, the surface having at least one longitudinal slope grade, the controller being configured to: receive the at least one longitudinal slope grade; receive a first blade side position of the first blade side; receive at least one target cross slope grade; and based on the at least one longitudinal slope grade and the first blade side position, adjust a second blade side position of the second blade side so as to impart the at least one target cross slope grade on the surface.

DETAILED DESCRIPTION

The present application describes mobile construction equipment, methods, and controllers used to establish cross slope grade $G_{CS}$ of a surface, such as a road, in ways that compensate for the surface having a longitudinal slope grade $G_{LS}$. In general, the mobile construction equipment may be a motor grader, such as motor grader 10. Motor grader 10 includes blade 30, which is movable with respect to motor grader 10 such that blade 30 can be used to impart or establish at least one cross slope section 108 having a cross slope grade $G_{CS}$ on a surface on which motor grader 10 is operating, such as road 100. When using an automatic cross slope control system, which automatically controls a second blade side 31B of blade 30 to impart a desired cross slope grade $G_{CS}$ on road 100 based on the operator manually controlling a first blade side 31A of blade 30, the mobile construction equipment, methods, and controllers of the present application avoid the shortcomings associated with the operator needing to take into account longitudinal slope grade $G_{LS}$ of road 100. By compensating for longitudinal slope grade $G_{LS}$ in this manner, the operator is able to focus on other tasks associated with implementing a desired cross slope grade $G_{CS}$ on road 100 (e.g., steering motor grader 10, manually controlling first blade side 31A, etc.).

Figure 1:
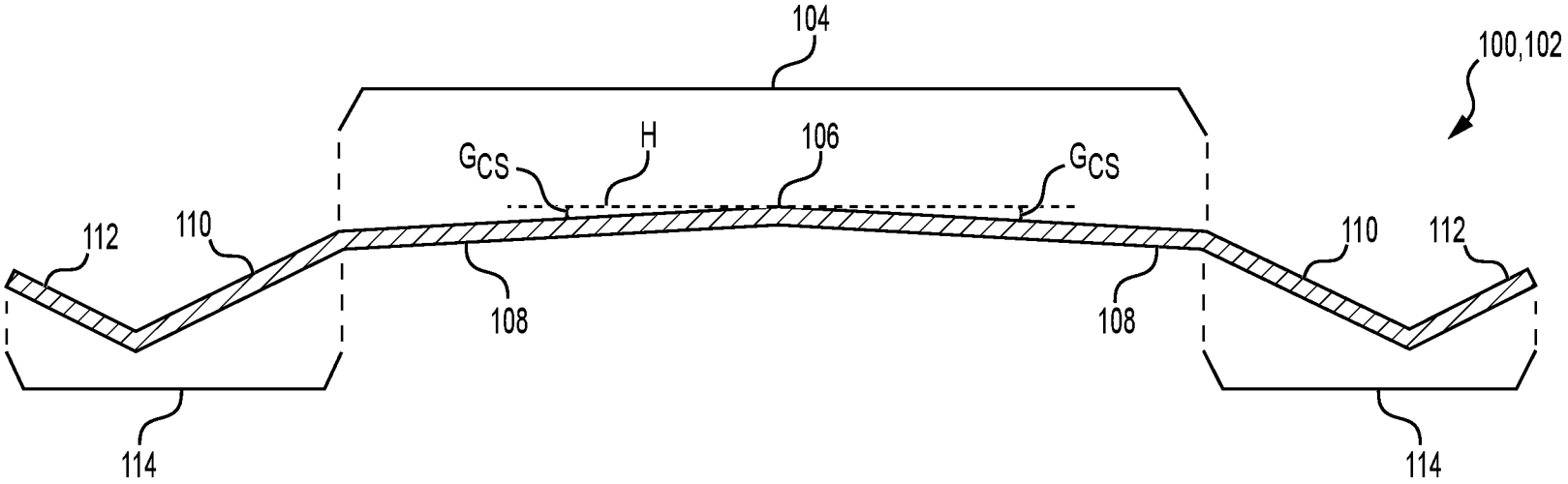
FIG. 1 PRIOR ART
FIG. 1 shows a cross section of a road.
Figure 2:
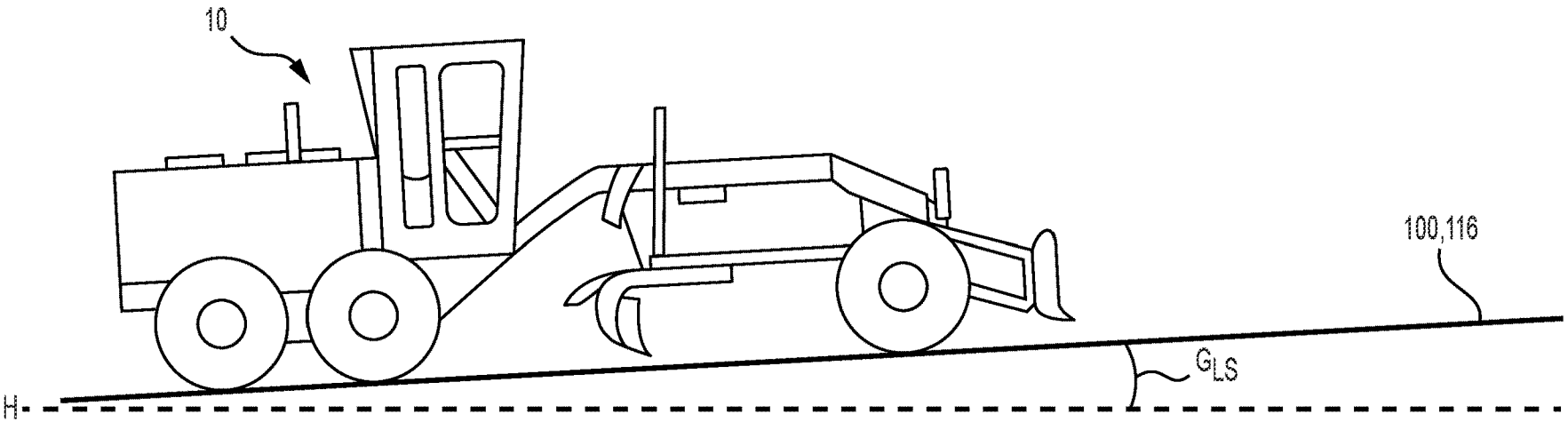
FIG. 2 shows longitudinal slope section of a road.
Figure 3:
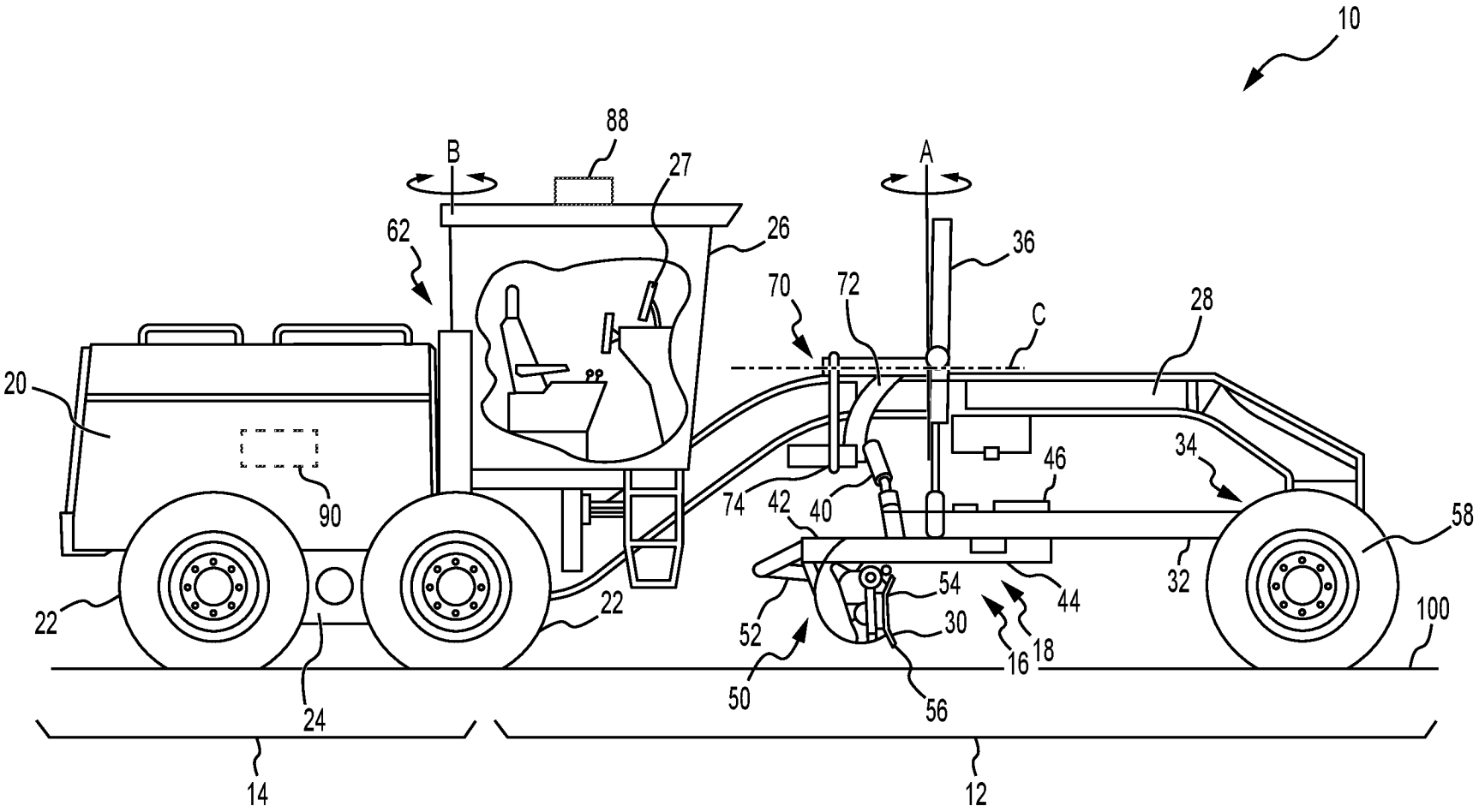
FIG. 3 PRIOR ART
FIG. 3 is a side view of a conventional motor grader.
Figure 4:
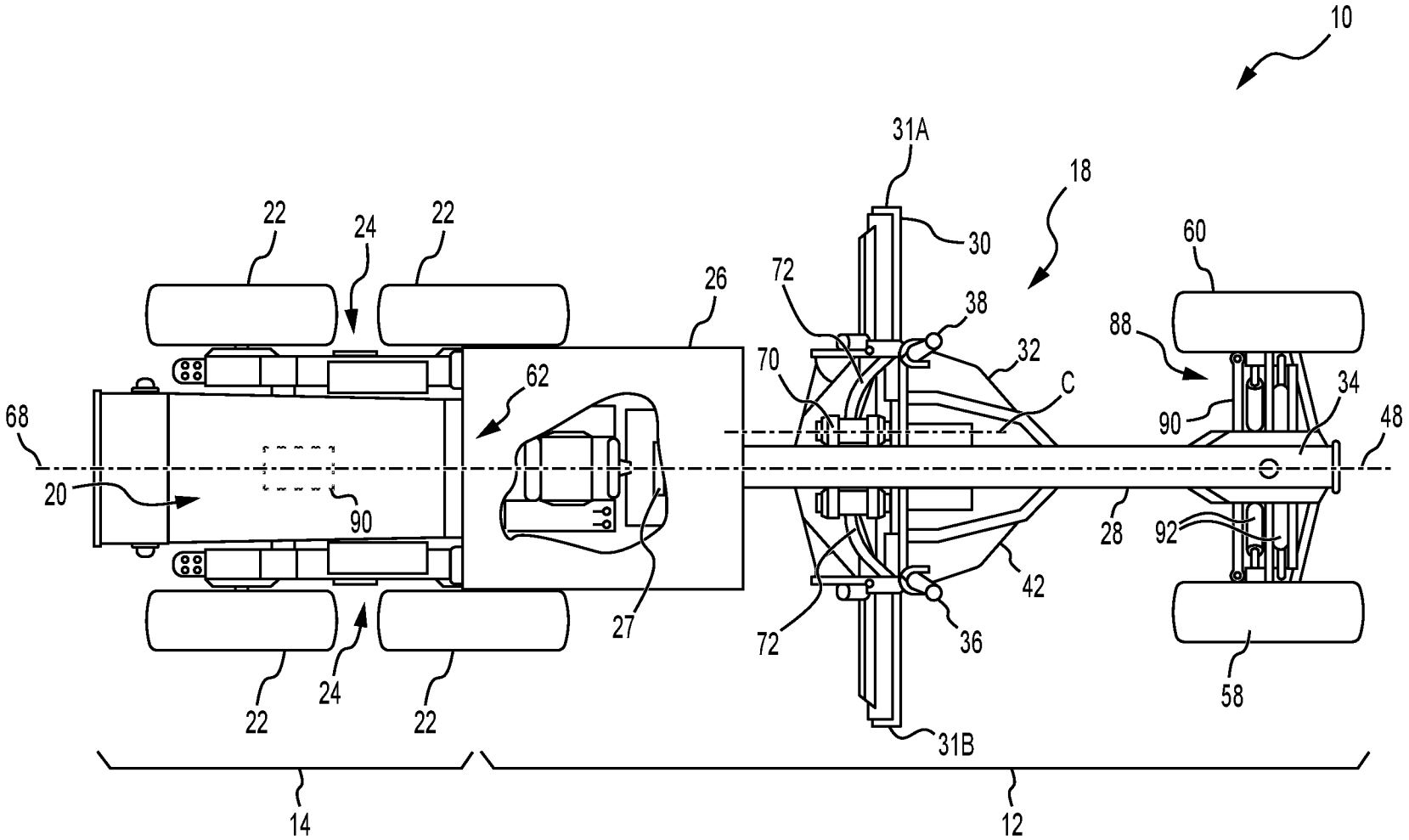
FIG. 4 PRIOR ART
FIG. 4 is a top view of the motor grader of FIG. 3.
Figure 5:
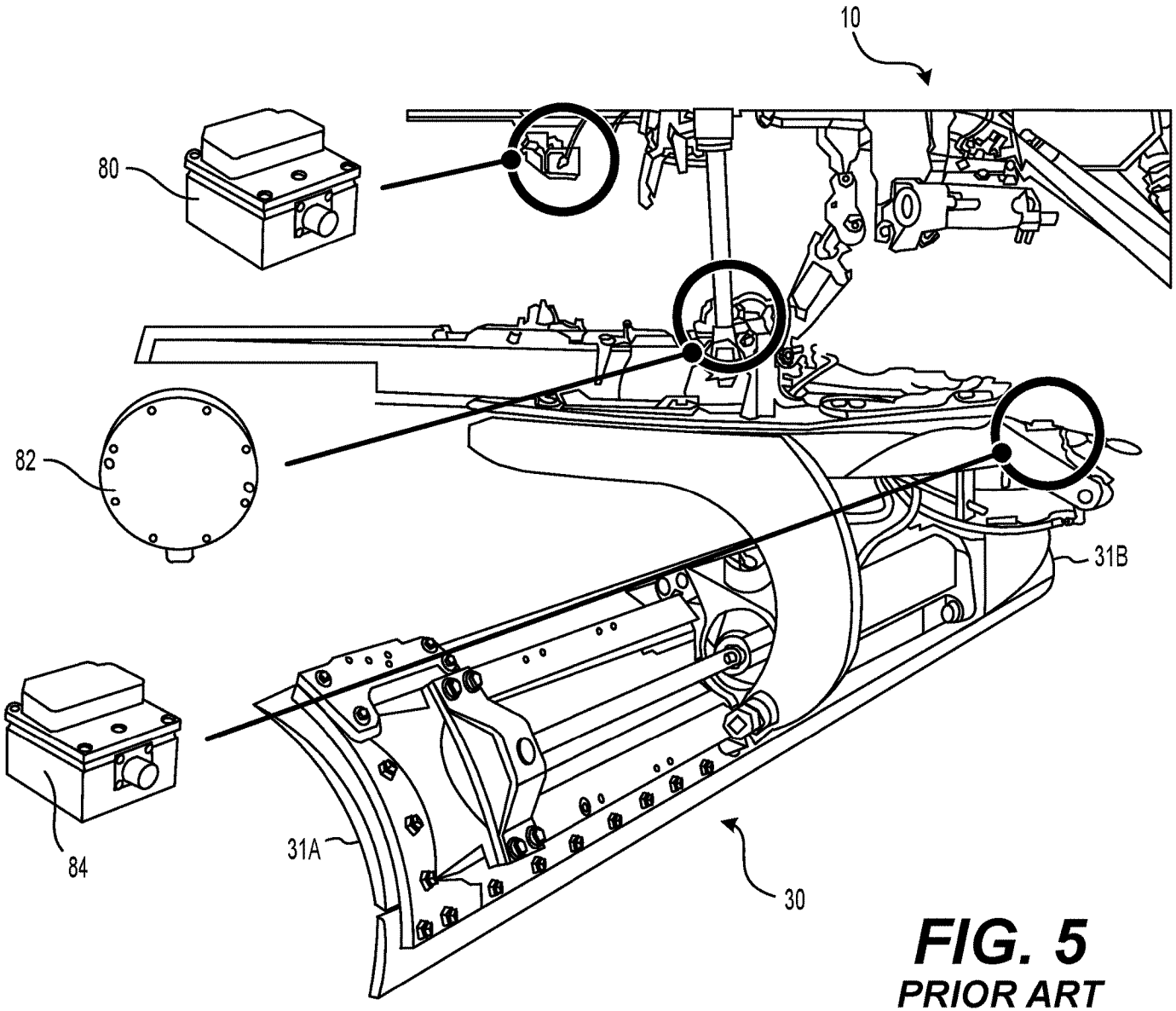
FIG. 5 PRIOR ART
FIG. 5 is a detail view showing the blade assembly of the motor grader of FIGS. 3-4.
Figure 6:
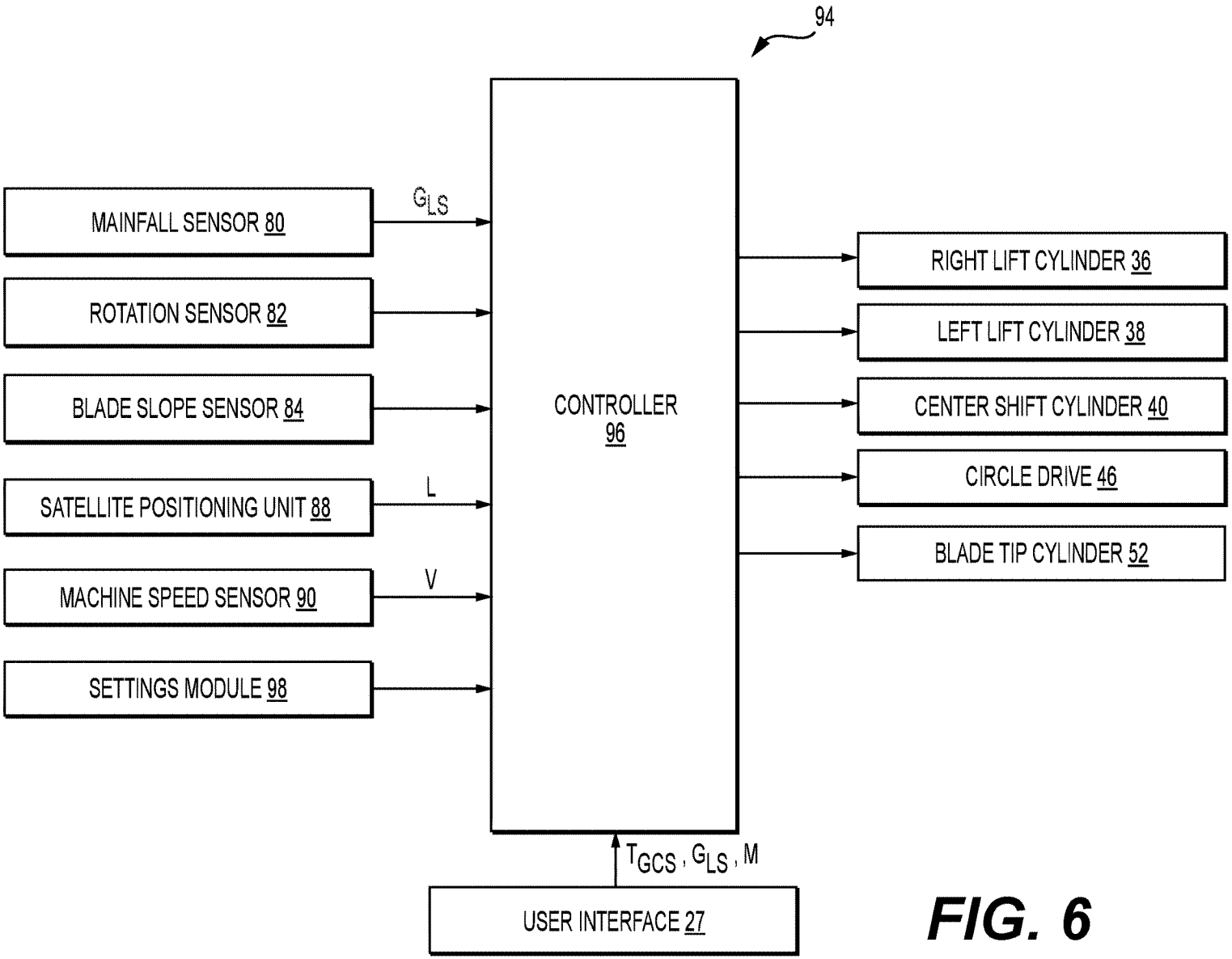
FIG. 6 shows a controller of the present disclosure for the motor grader of FIGS. 3-5.

FIG. 6 shows a block diagram of a control system 94 for motor grader 10. Control system 94 generally includes a controller, or electronic control module. 96 configured to receive a plurality of inputs from various sensors and/or operator commands, and to responsively provide outputs to control various actuators of motor grader 10 and/or communicate with the operator of motor grader 10. Controller 96 may include various components for executing software instructions designed to regulate subsystems of motor grader 10. For example, controller 96 may include a central processing unit (CPU), a random access memory (RAM), a read-only memory (ROM), input/output elements, etc. Controller 96 may execute machine readable instructions stored in controller 96 on a mass storage device, RAM, ROM, local memory, and/or on a removable storage medium, such as a CD, DVD, and/or flash memory device.

Control system 94 may incorporate a number of inputs, such as inputs from mainfall sensor 80, rotation sensor 82, blade slope sensor 84, satellite positioning unit 88, machine speed sensor 90, a settings module 98, and/or a user interface 27, among others. Settings module 98 may store setting information relating to local conditions and the surroundings of motor grader 10, which vary. Exemplary setting information includes, for example, information related to configurations of motor grader 10 that are specific to road 100 on which motor grader 10 operates (e.g., road surface material, road design, etc.).

User interface 27 may be disposed within operator station 26 of motor grader 10 so that the operator of motor grader 10 can input information into controller 96. Alternatively, user interface 27 could be located remote from motor grader 10 (e.g., if motor grader 10 is being operated autonomously). Exemplary information that may be inputted via user interface 27 can include one or more longitudinal slope grades $G_{LS}$ of road 100 on which motor grader 10 is operating. Alternatively, one or more longitudinal slope grades $G_{LS}$ of road 100 on which motor grader 10 is operating may be inputted into controller 96 by mainfall sensor 80.

Other exemplary information that may be inputted via user interface 27 can include one or more target cross slope grade $T_{GCS}$. A target cross slope grade $T_{GCS}$ is a desired grade of a particular location L on road 100. Different target cross slope grade $T_{GCS}$ may be associated with different locations L on road 100. For example, a first target cross slope grade $T_{GCS1}$ may be associated with a first location $L_1$ on road 100 (i.e., a first cross slope section 108), while a second target cross slope grade $T_{GCS2}$ may be associated with a second location $L_2$ on road 100 (i.e., a second cross slope section 108), second location $L_2$ being different than first location $L_1$.

Under ideal conditions, a given target cross slope grade $T_{GCS}$ would be exactly the same as a cross slope grade $G_{CS}$ actually imparted by motor grader 10 on cross slope section 108 of road 100. However, in real-world conditions, a target cross slope grade $T_{GCS}$, is, as its name suggests, a "target" for cross slope grade $G_{CS}$, understanding that motor grader 10 may not be able to obtain an exact one-to-one correspondence between target cross slope grade $T_{GCS}$ and cross slope grade $G_{CS}$ actually imparted by motor grader 10 on road 100. Nevertheless, target cross slope grade $T_{GCS}$ and cross slope grade $G_{CS}$ imparted by motor grader 10 on road 100, can, in practice, be considered equal.

Based at least in part on received longitudinal slope grade $G_{LS}$ and target cross slope grade $T_{GCS}$ information (e.g., input using user interface 27), controller 96 can issue various instructions to control a second blade side position $P_{31B}$ of the second blade side 31B of blade 30 so as to impart the at least one target cross slope grade $T_{GCS}$ on road 100. In particular, since controller 96 also receives a first blade side position $P_{31A}$ of first blade side 31A, controller 96 can output instructions that result in second blade side 31B being moved to a particular second blade side position Par such that blade 30, which extends between first blade side 31A and second blade side 31B, imparts the at least one target cross slope grade $T_{GCS}$ on road 100. To move second blade side 31B accordingly, controller 96 can issue instructions to actuate one or more of right lift cylinder 36, left lift cylinder 38, center shift cylinder 40, circle drive 46, blade tip cylinder 52, and/or any other actuators for moving blade 30 to transition second blade side 31B to a position consistent with a particular target cross slope grade $T_{GCS}$ on road 100.

In addition to longitudinal slope grade Gus and target cross slope grade $T_{GCS}$, controller 96 can also control second blade side position $P_{31B}$ based on other inputs, in that there may be at least one input into controller 96 in addition to one or more longitudinal slope grades Gus and one or more target cross slope grade $T_{GCS}$, as shown in FIG. 6. For example, satellite positioning unit 88 may input one more locations L of motor grader 10 (e.g., a first location $L_1$ and a second location $L_2$). These locations L may correspond to particular points of interest in the context of road 100, cross slope sections 108, and/or longitudinal slope sections 116, such as an intersection, bridge, rail crossing, cattle guard, etc. Machine speed sensor 90 may input a machine speed V of motor grader 10 into controller 96. Machine speed V can either be constant or variable. For example, at first location $L_1$, motor grader 10 could have a first machine speed $V_1$, while at second location $L_2$, motor grader 10 could have a second machine speed $V_2$ that is either higher, lower, or the same as $V_1$. Controller 96 could also receive inputs from one or more of mainfall sensor 80, rotation sensor 82, and blade slope sensor 84 so as to determine a difference between a current second blade side position $P_{31B}$ and a desired second blade side position $P_{31B}$, or between a current overall blade position $P_{30}$ and a desired overall blade position $P_{30}$, and whether further movement of second blade side 31B or blade 30 is needed to achieve a desired cross slope grade $G_{CS}$. Settings information could also be received via settings module 98 and used in determining how to actuate the various actuators.

Figure 7A:
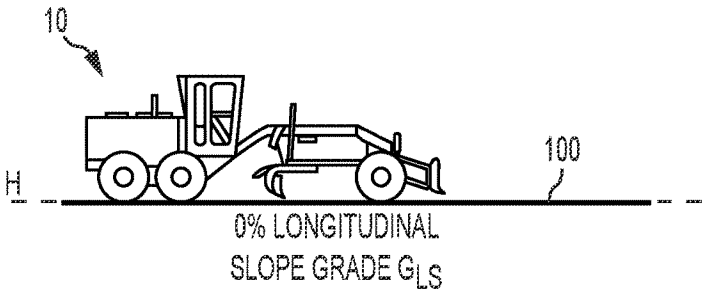
FIGS. 7A-7F show sample correlations between longitudinal slope grade and cross slope grade according to the present disclosure.
Figure 7B:
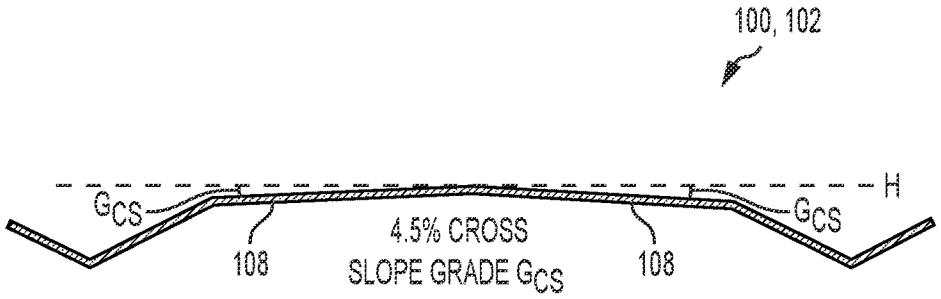
Figure 7C:
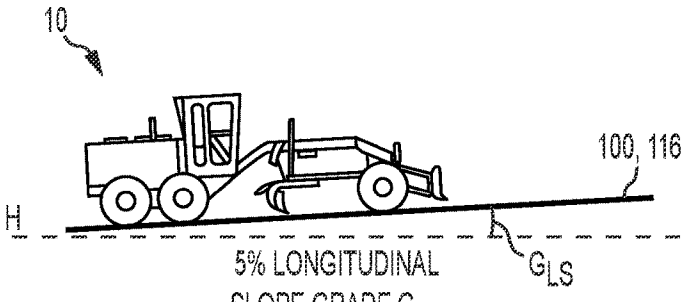
Figure 7D:
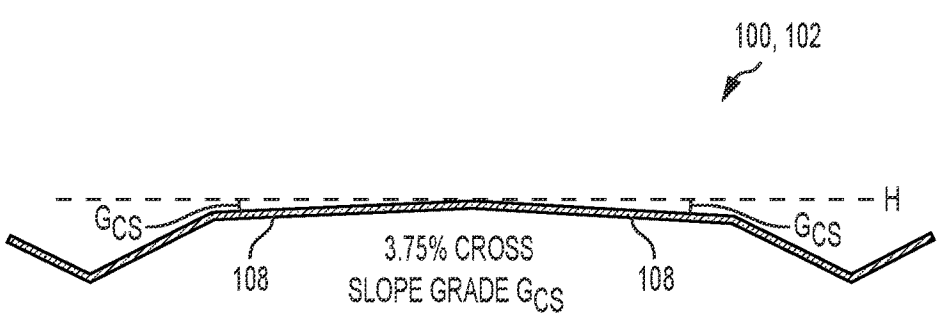
Figure 7E:
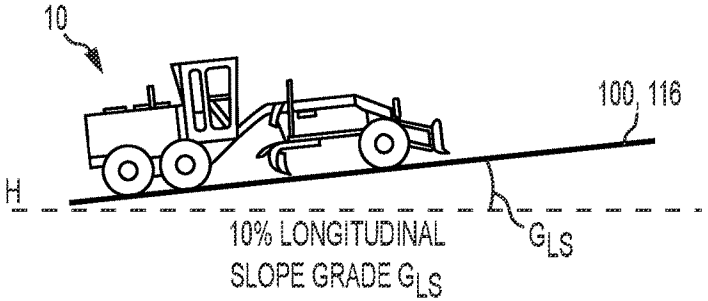
Figure 7F:
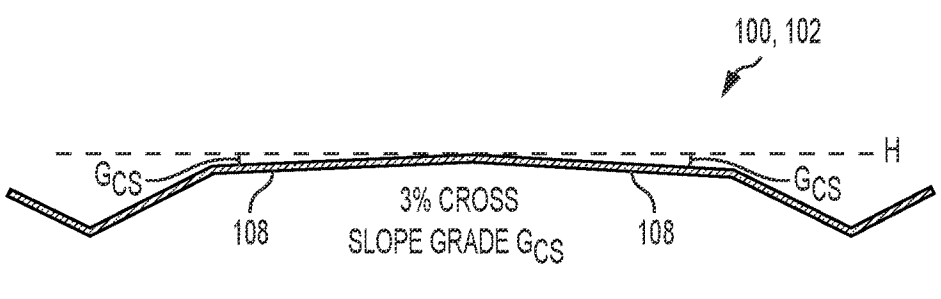

FIGS. 7A-7F show sample correlations between longitudinal slope grade $G_{LS}$ and cross slope grade $G_{CS}$. In general, as longitudinal slope grade Gus increases, a cross slope grade $G_{CS}$ desired to be imparted on road 100 decreases. This is due in part to cross slope section 108 (and its attendant cross slope grade $G_{CS}$) needing to provide less of a drainage function given that longitudinal slope section 116 (and its attendant longitudinal slope grade $G_{LS}$) also provides a drainage function. For example. FIGS. 7A and 7B show that when road 100 has no longitudinal slope section 116, and therefore no or zero longitudinal slope grade $G_{LS}$ (as shown in FIG. 7A), cross slope grade $G_{CS}$ of cross slope section 108 associated with that particular section of road 100 should be relatively higher (e.g., a cross slope grade $G_{CS}$ of 4.5%, as shown in FIG. 7B). FIGS. 7C and 7D show that when road 100 has a longitudinal slope section 116, and therefore some non-zero longitudinal slope grade $G_{LS}$ (e.g., a longitudinal slope grade $G_{LS}$ of 5%, as shown in FIG. 7C), cross slope grade $G_{CS}$ of cross slope section 108 associated with that longitudinal slope section 116 of road 100 can be relatively lower (e.g., a cross slope grade $G_{CS}$ of 3.75%, as shown in FIG. 7D). FIGS. 7E and 7F show that when road 100 has a more significant longitudinal slope section 116, and therefore a greater non-zero longitudinal slope grade $G_{LS}$ (e.g., a longitudinal slope grade $G_{LS}$ of 10%, as shown in FIG. 7E), cross slope grade $G_{CS}$ of cross slope section 108 associated with that longitudinal slope section 116 of road 100 can be lower still (e.g., a cross slope grade $G_{CS}$ of 3%, as shown in FIG. 7F).

Figure 8A:
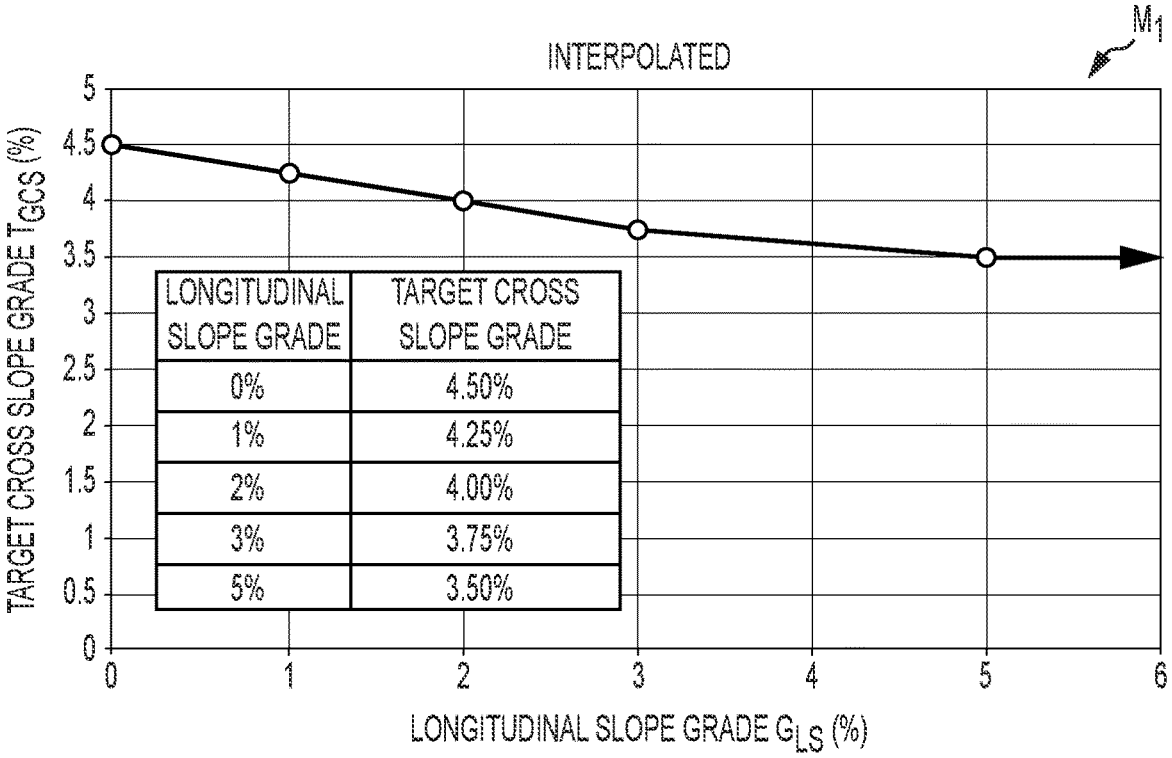
FIGS. 8A-8B show maps of sample correlations between longitudinal slope grade and target cross slope grade according to the present disclosure.
Figure 8B:
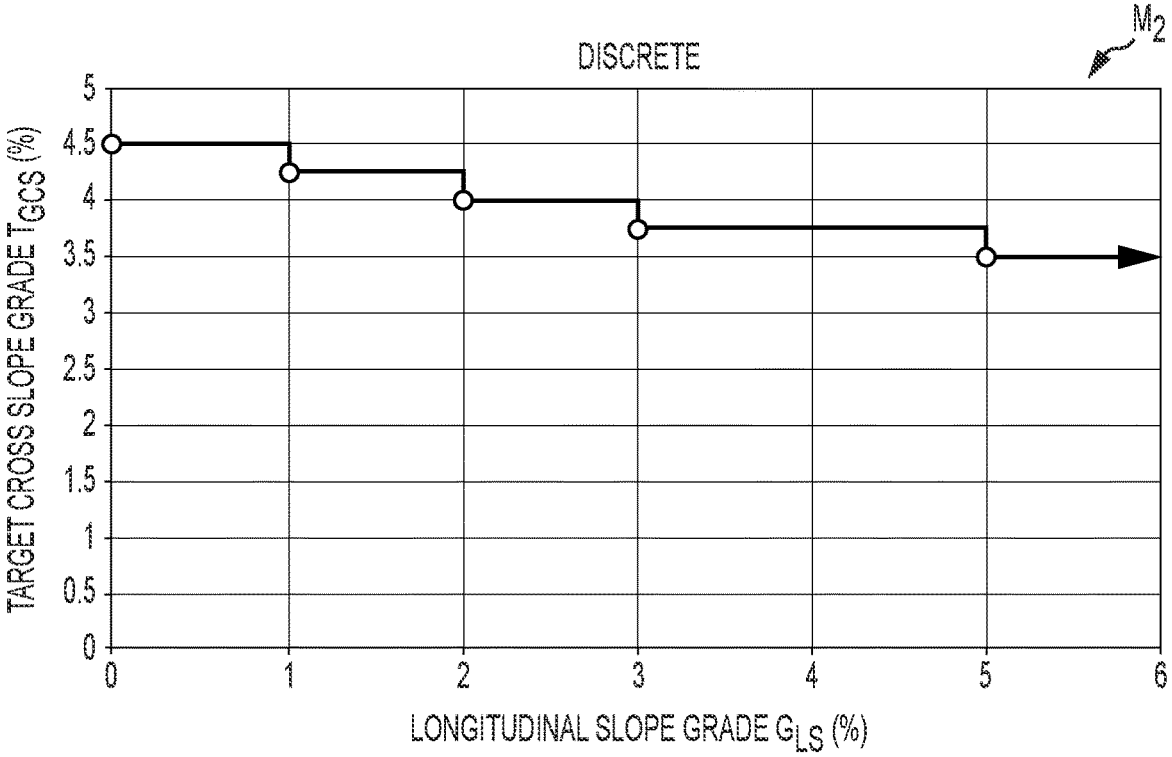

FIGS. 8A-8B show maps M of sample correlations between longitudinal slope grade $G_{LS}$ and target cross slope grade $T_{GCS}$. One or more maps M may be input into controller 96 (e.g., by an operator of motor grader 10 via user interface 27, or remotely if motor grader 10 is being operated autonomously). For example, it may be desirable to make a predetermined decision about what target cross slope grade $T_{GCS}$ would be appropriate for a given longitudinal slope grade $G_{LS}$, particularly when motor grader 10 is operating on a road 100 with more than one longitudinal slope section 116 each having its own longitudinal slope grade $G_{LS}$, or with a single longitudinal slope section 116 having multiple longitudinal slope grades $G_{LS}$ associated with it. In such instances, motor grader 10 needs to be capable of imparting cross slope grade $G_{CS}$ on a plurality of longitudinal slope section 116, each potentially having a different longitudinal slope grade $G_{LS}$. Moreover, each longitudinal slope grade $G_{LS}$ of the plurality of different longitudinal slope grades $G_{LS}$ may need to associated with its own distinct target cross slope grade $T_{GCS}$, such that there may be a plurality of target cross slope grades $T_{GCS}$ that motor grader 10 would need to be capable of imparting on road 100.

FIG. 8A shows a first map $M_1$ that correlates a plurality of different longitudinal slope grades $G_{LS}$ with a plurality of target cross slope grades $T_{GCS}$. In this example, there are five distinct longitudinal slope grades Gus (i.e., 0%, 1%, 2%, 3%, and 5%), each corresponding to a data point on map $M_1$. For each of the five distinct longitudinal slope grades $G_{LS}$, map $M_1$ provides a corresponding target cross slope grade $T_{GCS}$ (i.e., 4.50%, 4.25%, 4.00%, 3.75%, and 3.50%, respectively) that would be capable of providing suitable drainage on road 100. In this manner, map $M_1$ correlates each longitudinal slope grade $G_{LS}$ with the at least one target cross slope grade $T_{GCS}$. When map $M_1$ is input into controller 96, controller 96 can then determine which target cross slope grade $T_{GCS}$ should be used for a given longitudinal slope grade $G_{LS}$ (whether the given longitudinal slope grade $G_{LS}$ is input via user interface 27 or sensed by mainfall sensor 80). Map $M_1$ also interpolates target cross slope grade $T_{GCS}$ between each longitudinal slope grade $G_{LS}$, such that a line connecting each data point on map $M_1$ is smooth, with the target cross slope grade $T_{GCS}$ varying accordingly between different longitudinal slope grades $G_{LS}$. In this manner, FIG. 8A shows more than one target cross slope grade $T_{GCS}$, via interpolation, for each longitudinal slope grade $G_{LS}$.

FIG. 8B shows a second map $M_2$ that correlates a plurality of different longitudinal slope grades Gus with a plurality of target cross slope grades $T_{GCS}$ in a manner different than map $M_1$. In this example, there are still five distinct longitudinal slope grades $G_{LS}$ (i.e., 0%, 1%, 2%, 3%, and 5%) each corresponding to a data point on map $M_2$. For each of the five distinct longitudinal slope grades $G_{LS}$, map $M_2$ also provides a corresponding target cross slope grade $T_{GCS}$ (i.e., 4.50%, 4.25%, 4.00%, 3.75%, and 3.50%, respectively) that would be capable of providing suitable drainage on road 100, similar to map $M_1$. However, unlike map $M_1$, map $M_2$ maintains a discrete target cross slope grade $T_{GCS}$ between each distinct longitudinal slope grade $G_{LS}$, such that a line connecting each data point on map $M_2$ is step-like.

Maps $M_1$ and $M_2$ are but two examples of possible correlations between longitudinal slope grade $G_{LS}$ and target cross slope grade $T_{GCS}$. Other maps M are possible and considered to be within the scope of the present disclosure.

Figure 9A:
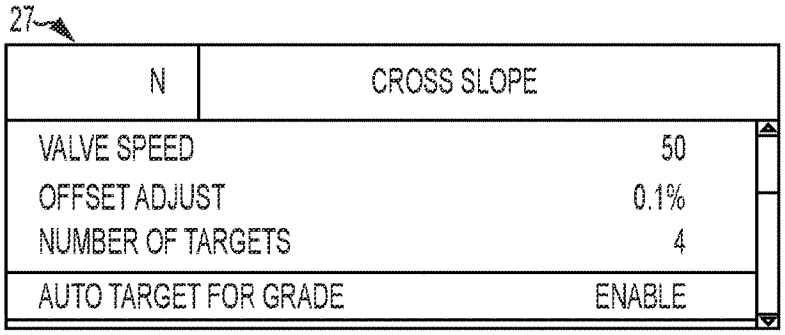
FIGS. 9A-9E show sample correlation input screens according to the present disclosure.

FIGS. 9A-9E show sample correlation input screens that may appear on user interface 27 and be used to manually create maps M correlating longitudinal slope grade $G_{LS}$ and target cross slope grade $T_{GCS}$, such as maps $M_1$ and $M_2$ in FIGS. 8A and 8B. For example, as shown in FIG. 9A, the operator of motor grader 10 has the ability to enable the ability of the automatic cross slope control system of motor grader 10 to automatically adjust target cross slope grade $T_{GCS}$ to compensate for longitudinal slope grade $G_{LS}$ (e.g., by setting "Auto Target for Grade" to "Enable").

Figure 9B:
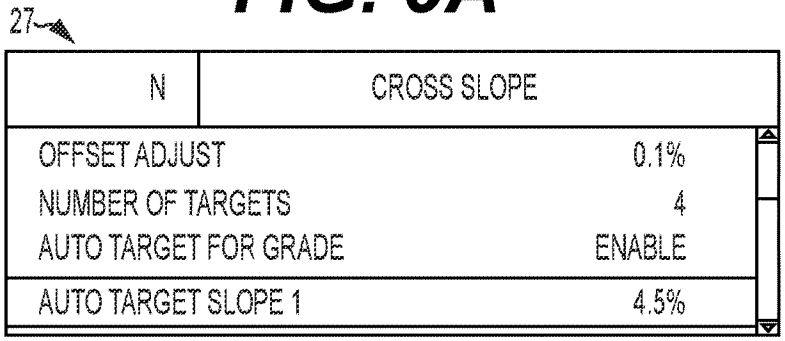
Figure 9C:
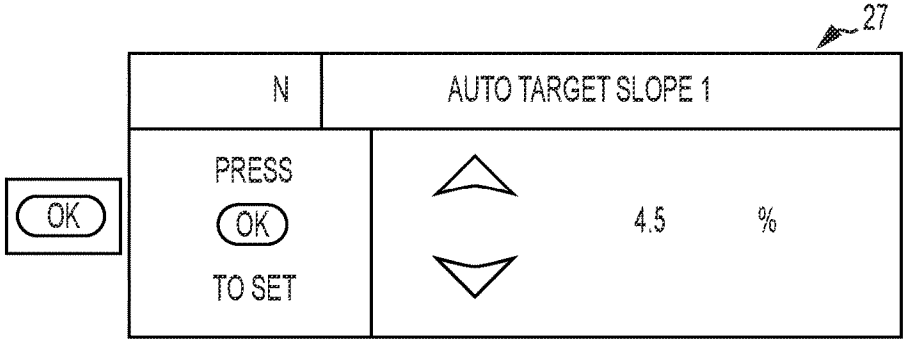

Progressing to FIGS. 9B and 9C, the operator has the ability, using user interface 27, to enter a first target cross slope grade $T_{GCS}$, in this instance of 4.5% (e.g., by selecting "Auto Target Slope 1," hitting "OK," then adjusting "Auto Target Slope 1" to 4.5%). Entering this setting corresponds to setting the Y-coordinate of the leftmost data point in map $M_1$ or $M_2$ to a target cross slope grade $T_{GCS}$ of 4.5%.

Figure 9D:
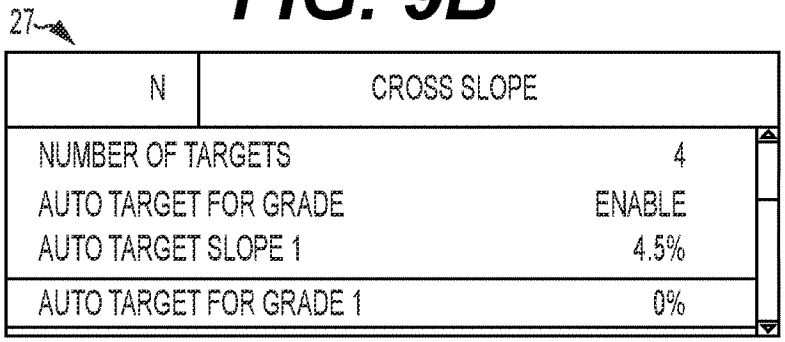
Figure 9E:
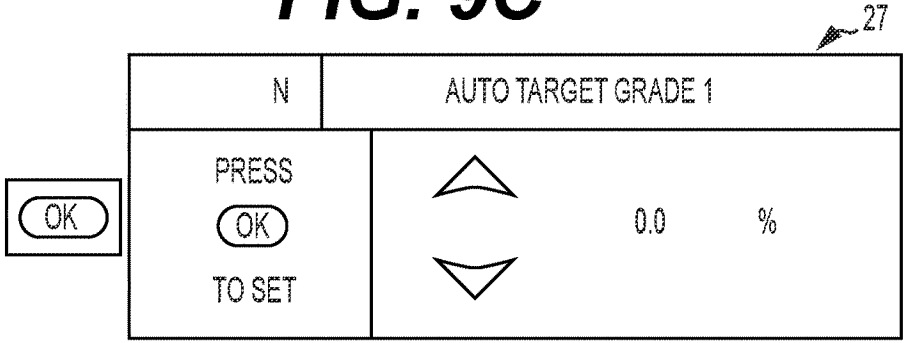

Moving to FIGS. 9D and 9E, the operator of motor grader 10 can then enter a longitudinal slope grade $G_{LS}$, or X-coordinate of the leftmost data point in map $M_1$ or $M_2$, corresponding to the target cross slope grade $T_{GCS}$ of 4.5%. In this example, the corresponding longitudinal slope grade $G_{LS}$ is 0.0%. To input this value, the user navigates to "Auto Target for Grade 1," presses "OK," then adjusts "Auto Target Grade 1" to 0.0%. Doing so maps the first (i.e., leftmost) data point on map $M_1$ or $M_2$. The user can then repeat this process for each of the remaining data points on map $M_1$ or $M_2$, of which there are four in this example. While maps $M_1$ and $M_2$ include five data points in total, each of which correlates a longitudinal slope grade $G_{LS}$ to a target cross slope grade $T_{GCS}$, other numbers of data points are possible and within the scope of the present disclosure.

INDUSTRIAL APPLICABILITY

In general, the mobile construction equipment, methods, and controllers of the present application are applicable for automatically compensating for longitudinal slope grade when grading a road to impart a particular cross slope grade. By inputting information that correlates at least one longitudinal slope grade with at least one target cross slope grade, the mobile construction equipment, methods, and controllers of the present application allow an operator of a motor grader to avoid needing to take into consideration one additional variable (i.e., longitudinal slope grade) when trying to impart cross slope grade on a road. By removing longitudinal slope grade from the operator's consideration, the operator can more effectively operate the motor grader to impart a proper cross slope grade on the road, which ultimately results in improved road quality (e.g., better drainage, longer life, etc.).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The present disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A mobile construction equipment for operation on a surface having at least one longitudinal slope grade, the mobile construction equipment comprising:

a blade that is movable with respect to the mobile construction equipment, the blade having a first blade side and a second blade side opposite the first blade side, the blade being configured to impart at least one cross slope grade on the surface; and a controller configured to receive the at least one longitudinal slope grade, a first blade side position of the first blade side, and at least one target cross slope grade, and, based on the at least one longitudinal slope grade and the first blade side position, adjust a second blade side position of the second blade side so as to impart the at least one target cross slope grade on the surface.

2. The mobile construction equipment of claim 1, further comprising:

a user interface, wherein the map is input into the controller via the user interface.

3. The mobile construction equipment of claim 1, further comprising:

at least one mainfall sensor configured to sense the at least one longitudinal slope grade.

4. The mobile construction equipment of claim 1, wherein the at least one longitudinal slope grade comprises a plurality of longitudinal slope grades, and wherein the controller is configured to receive a map that correlates each longitudinal slope grade of the plurality of longitudinal slope grades with the at least one target cross slope grade.

5. The mobile construction equipment of claim 4, wherein, after adjusting the second blade side position to impart on the surface a first target cross slope grade of the at least one target cross slope grade, the controller is configured, based on the map and a change from a first longitudinal slope grade of the plurality of longitudinal slope grades to a second longitudinal slope grade of the plurality of longitudinal slope grades, to adjust the second blade side position to impart on the surface a second target cross slope grade of the at least one target cross slope grade.

6. The mobile construction equipment of claim 4, wherein the at least one target cross slope grade comprises a plurality of target cross slope grades.

7. The mobile construction equipment of claim 6, wherein the map correlates each longitudinal slope grade with more than one target cross slope grade of the plurality of target cross slope grades.

8. The mobile construction equipment of claim 6, wherein the map correlates each longitudinal slope grade with only one target cross slope grade of the plurality of target cross slope grades.

9. A method for imparting at least one cross slope grade on a surface using a mobile construction equipment having a blade with a first blade side and a second blade side opposite the first blade side, the surface having at least one longitudinal slope grade, the method comprising:

receiving the at least one longitudinal slope grade, a first blade side position of the first blade side, and at least one target cross slope grade; and based on the at least one longitudinal slope grade and the first blade side position, adjusting a second blade side position of the second blade side so as to impart the at least one target cross slope grade on the surface.

10. The method of claim 9, wherein the at least one longitudinal slope grade comprises a plurality of longitudinal slope grades, and wherein the method further comprises receiving a map that correlates each longitudinal slope grade of the plurality of longitudinal slope grades with the at least one target cross slope grade.

11. The method of claim 9, wherein receiving the at least one longitudinal slope grade comprises receiving the at least one longitudinal slope grade from at least one mainfall sensor of the mobile construction equipment.

12. The method of claim 10, wherein receiving the map comprises inputting the map into a user interface of the mobile construction equipment, the user interface being operatively connected to a controller of the mobile construction equipment.

13. The method of claim 12, wherein, after adjusting the second blade side position to impart on the surface a first target cross slope grade of the at least one target cross slope grade, the controller is configured, based on the map and a change from a first longitudinal slope grade of the plurality of longitudinal slope grades to a second longitudinal slope grade of the plurality of longitudinal slope grades, to adjust the second blade side position to impart on the surface a second target cross slope grade of the at least one target cross slope grade.

14. The method of claim 12, wherein the at least one target cross slope grade comprises a plurality of target cross slope grades.

15. The method of claim 14, wherein the map correlates each longitudinal slope grade with more than one target cross slope grade of the plurality of target cross slope grades.

16. The method of claim 14, wherein the map correlates each longitudinal slope grade with only one target cross slope grade of the plurality of target cross slope grades.

17. A controller for a mobile construction equipment having a blade that is movable with respect to the mobile construction equipment to impart at least one cross slope grade on a surface on which the mobile construction equipment is operating, the blade having a first blade side and a second blade side opposite the first blade side, the surface having at least one longitudinal slope grade, the controller being configured to:

receive the at least one longitudinal slope grade;

receive a first blade side position of the first blade side;

receive at least one target cross slope grade; and based on the at least one longitudinal slope grade and the first blade side position, adjust a second blade side position of the second blade side so as to impart the at least one target cross slope grade on the surface.

18. The controller of claim 17, wherein the at least one longitudinal slope grade comprises a plurality of longitudinal slope grades, and wherein the controller is configured to receive a map that correlates each longitudinal slope grade of the plurality of longitudinal slope grades with the at least one target cross slope grade.

19. The controller of claim 18, wherein the at least one target cross slope grade comprises a plurality of target cross slope grades, and wherein the map correlates each longitudinal slope grade with more than one target cross slope grade of the plurality of target cross slope grades.

20. The controller of claim 18, wherein the at least one target cross slope grade comprises a plurality of target cross slope grades, and wherein the map correlates each longitudinal slope grade with only one target cross slope grade of the plurality of target cross slope grades.

* * * * *